US006964624B2

(12) United States Patent
Shen et al.

(10) Patent No.: US 6,964,624 B2
(45) Date of Patent: Nov. 15, 2005

(54) BUMPER GUARD FOR A SPORTS RACQUET

(75) Inventors: Walter W. C. Shen, Taichung (TW); David W. Repetto, Chicago, IL (US); Po-Jen Cheng, Rancho Santa Fe, CA (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 10/715,068

(22) Filed: Nov. 17, 2003

(65) Prior Publication Data

US 2005/0159253 A1 Jul. 21, 2005

(51) Int. Cl.[7] ..... A63B 51/00
(52) U.S. Cl. ..... 473/521; 473/539; 473/548
(58) Field of Search ..... 473/539, 540, 473/548, 520–522

(56) References Cited

U.S. PATENT DOCUMENTS 4,496,152 A 1/1985 Mott
4,889,337 A * 12/1989 Todd ..... 473/522
5,029,859 A 7/1991 Davis
5,102,132 A 4/1992 Chen
5,165,687 A 11/1992 Soong
5,280,907 A 1/1994 Liu
5,362,071 A 11/1994 Liu
5,458,331 A * 10/1995 Bothwell ..... 473/534
5,944,625 A 8/1999 Janes et al.
6,336,877 B1 1/2002 Arroyo et al.
6,503,161 B2 1/2003 Bothwell
6,530,851 B2 3/2003 Munster

* cited by examiner

*Primary Examiner*—Raleigh W. Chiu
(74) *Attorney, Agent, or Firm*—Terence P. O'Brien

(57) ABSTRACT

A bumper guard for attachment to a sports racquet. The sports racquet includes a frame having a head portion with an outer peripheral surface and a plurality of grommet holes formed into the head portion for supporting a string bed. The bumper guard includes an elongate body having a first length, an inner surface and an outer surface. The body includes a central region and first and second wings. The central region, when installed on the racquet, is generally centered about a plane defined by the string bed. The first and second wings extend from the central region. The inner surface of the body configured to generally conform with the peripheral outer surface of the head portion. Each of the first and second wings has an inner wall and an outer wall defining at least one elongate hollow cavity.

20 Claims, 7 Drawing Sheets

BUMPER GUARD FOR A SPORTS RACQUET

FOREIGN APPLICATION PRIORITY DATA

Jun. 20, 2003 [CN] China . . . 03247635.3

FIELD OF THE INVENTION

The present invention relates generally to a sports racquet. In particular, the present invention relates to an improved bumper guard for protecting a frame of a sports racquet.

BACKGROUND OF THE INVENTION

Sport racquets, such as tennis, racquetball, squash and badminton racquets, are well known and typically include a frame having a head portion coupled to a handle assembly. The head portion forms a hoop having inner and outer surfaces and a number of grommet holes, which are typically drilled through the inner and outer surfaces of the head portion. A bumper guard is often placed on at least a portion of the outer surface of the head portion of the racquet in order to protect the head portion of the racquet from damage resulting from impacts with the ground, walls, and other structures during play. These impacts between the head portion of the racquet frame and the ground, walls and/or other hard objects often occur frequently during play. The bumper guard are typically formed of a wear and impact resistant material to inhibit damage to the head portion of the racquet frame including abrasions, cracking and wear. Existing bumper guards typically are configured to generally conform to the outer surface of the head portion of the racquet frame including a centrally extending recess for receiving racquet string. Existing bumper guards also typically include string holes and/or grommets for enabling racquet string to be routed over and through the bumper guard and the racquet frame.

Existing bumper guards have drawbacks. In order to provide sufficient protection to the racquet frame, bumper guards typically must be formed of hard, tough, durable material having sufficient thickness to absorb the frequent impacts with hard surfaces and objects. The bumper guard cannot be formed of a material so hard that it becomes brittle. As such, the material thickness often determines the service life of a bumper guard. In order to provide a service life of sufficient duration, bumper guards are often formed of materials having considerable thickness. Although the increased thickness can increase the service life of the bumper guard, it also results in increased, and often undesirable, extra weight added to the head portion of the racquet.

Existing bumper guards typically also do little to reduce or dampen the shock and vibration, resulting from impacts with hard surfaces and objects, that is passed onto the racquet frame and ultimately is felt by the user.

In an attempt to address these drawbacks, some existing bumper guard configurations include a pair of opposing wings or flanges outwardly extending from the longitudinal centerline of the bumper guard, wherein a portion of each wing or flange is spaced apart or floating over the head portion of the racquet frame to form a plurality of openings. The openings can be unfilled, or filled with an elastomeric material. The spaced apart configuration of a portion of the wings from the head portion of the racquet frame provide a cushion of air or elastomeric material between the bumper guard and the head portion of the racquet frame. Although these types of configurations can reduce the weight of the bumper guard and can provide additional shock absorption, upon impact, the outer surface of the bumper guard and/or the elastomeric material placed into the openings can be compressed against the head portion of the racquet frame leading to mechanical abrasion and wear against the outer surface of the racquet frame. In yet another attempt to improve a bumper guard, a lumen is installed into each opening between the wings of the bumper guard and the head portion of the racquet frame. The lumens can be hollow or filled with an elastomeric material. The lumens due not fill the entire opening between the wings and the racquet frame and are compressible and capable of moving relative to the racquet frame. As a result, the lumens and/or the wings of the bumper guard can also rub or wear against the racquet frame during impact potentially resulting in damage or wear to the racquet frame.

Thus, there is a continuing need for an improved bumper guard that can provide proper protection to the racquet frame without adding excessive or unnecesary weight to the racquet. There is also a continuing need for an improved bumper guard that reduces the amount of shock and vibration felt by the user from impact with a ball. What is also needed is an improved bumper guard that does not enable a deflectable outer wing of the bumper guard to deflect, rub or otherwise wear against the head portion of the racquet frame.

SUMMARY OF THE INVENTION

The present invention provides a bumper guard for attachment to a sports racquet. The sports racquet includes a frame having a head portion with an outer peripheral surface and a plurality of grommet holes formed into the head portion for supporting a string bed. The bumper guard includes an elongate body having a first length, an inner surface and an outer surface. The body includes a central region and first and second wings. The central region, when installed on the racquet, is generally centered about a plane defined by the string bed. The first and second wings extend from the central region. The inner surface of the body configured to generally conform with the peripheral outer surface of the head portion. Each of the first and second wings has an inner wall and an outer wall defining at least one elongate hollow cavity. The inner wall of each of the first and second wings extends from the central region and is configured to contact the outer peripheral surface of the racquet.

According to a principal aspect of the invention, a sports racquet includes a frame, a bumper guard and a string bed. The frame has a head portion with an outer peripheral surface and a plurality of grommet holes formed into the head portion for supporting the string bed. The bumper guard is removably engaged with the frame. The bumper guard includes an elongate body having a first length, an inner surface and an outer surface. The body includes a central region, which is generally centered about a plane defined by the string bed, and first and second wings extending from the central region. The inner surface of the body generally conforming with the peripheral outer surface of the head portion. Each of the first and second wings having an inner wall and an outer wall defining at least one elongate hollow cavity. The inner wall of each of the first and second wings extends from the central region and contacts the outer peripheral surface of the racquet.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
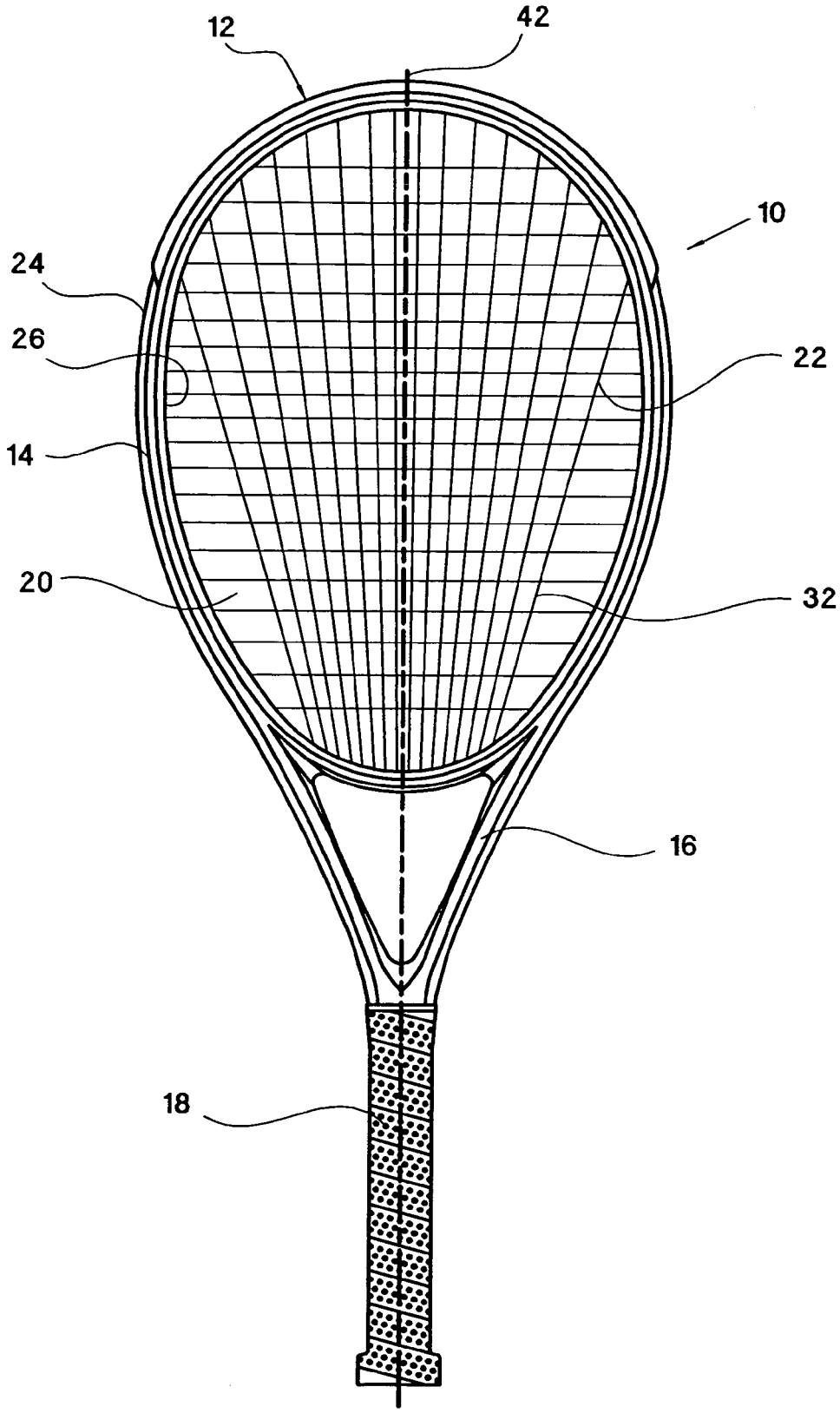
FIG. 1 is a front view of a racquet in accordance with a preferred embodiment of the present invention.

Referring to FIG. 1, a sports racquet is indicated generally at 10. The racquet 10 of FIG. 1 is configured as a tennis racquet, however, the invention can also be formed as other types of sports racquets, such as, for example, a racquetball racquet, a squash racquet, or a badminton racquet. The racquet 10 includes a frame and a bumper guard 12. The frame defines a head portion 14, a throat region 16 and a handle assembly 18. The head portion 14 is a tubular structure defining a generally oval shaped opening 20 for supporting a latticework of strings in tension (a string bed 22) defining a string plane.

Figure 2:
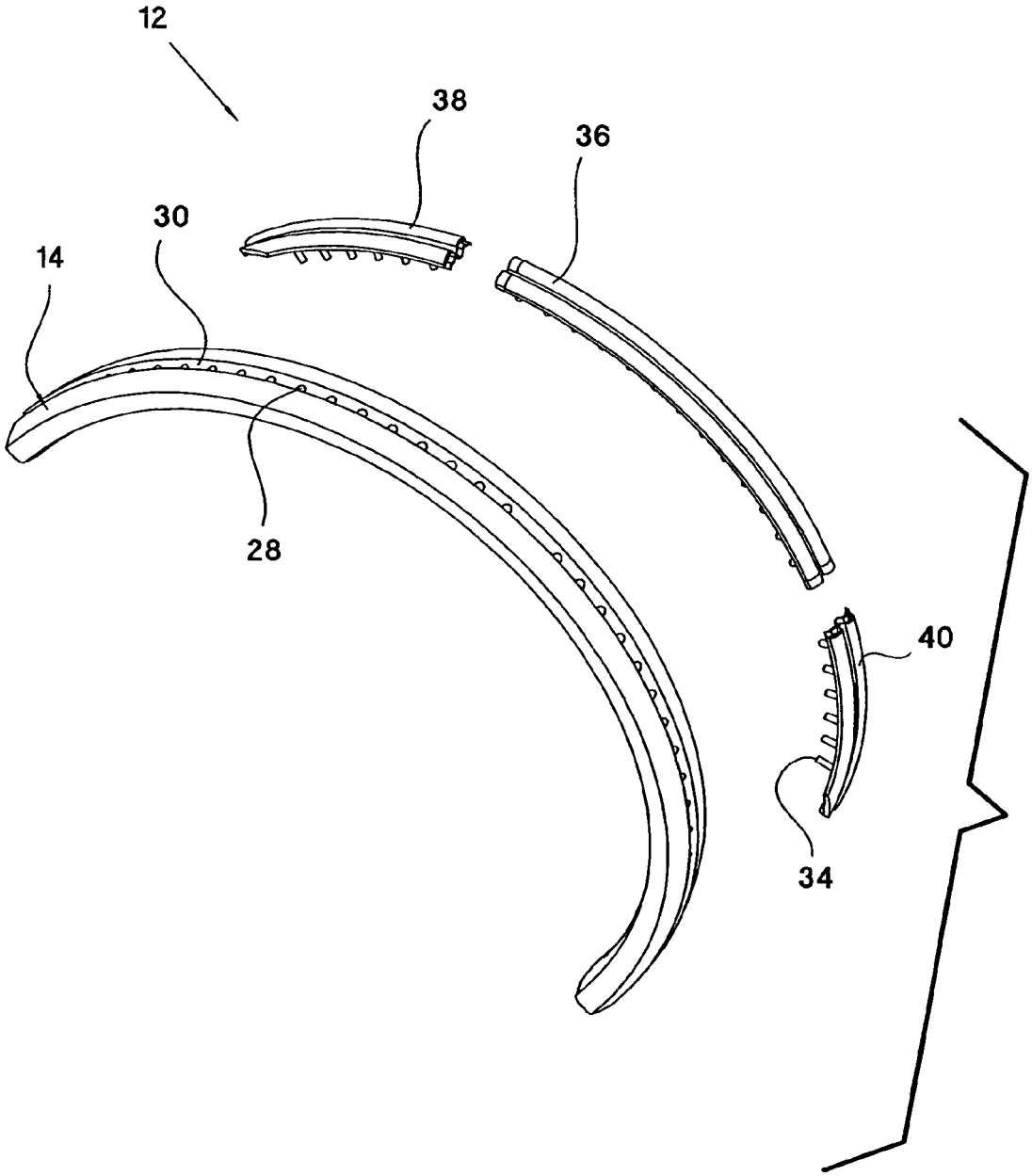
FIG. 2 is a front, top exploded perspective view of an upper portion of the racquet including a bumper guard of FIG. 1.

Referring to FIGS. 1 and 2, the head portion 14 has an outwardly facing surface 24, an inwardly facing surface 26, and a plurality of grommet holes 28 extending through the inwardly and outwardly facing surfaces 26 and 24. A first elongate recess 30 is preferably formed into at least a portion of the outer surface 24 of the head portion 14. The first recess 30 is sized to receive at least a portion of at least one racquet string 32, and, optionally a portion of the bumper guard 12 or a portion of a grommet assembly (not shown), such that the racquet string 32 can extend about a portion of the outer periphery of the racquet 10 without outwardly projecting farther than the head portion 14, the bumper guard 12 or the grommet assembly. The throat region 16 includes a pair of tubular shafts outwardly extending from the head portion 14 and converging at the handle assembly 18. The handle assembly 18 connects to and outwardly extends from the throat region 16.

Referring to FIG. 2, the bumper guard 12 is a flexible elongate structure removably attached to at least a portion of the head portion 14. The bumper guard 12 is preferably configured to receive, and to facilitate support of, the at least one racquet string 32 (see FIG. 1), and to prevent direct contact between the racquet string 32 and the generally roughened edges of the hoop portion 14 at the grommet holes 28. The bumper assembly 12 preferably includes a plurality of grommet members 34. In a preferred embodiment, the bumper assembly 12 is comprised of a central guard portion 36 positioned between first and second end guard portions 38 and 40. In one particularly preferred embodiment, the first and second end guard portions 38 and 40 are positioned at approximately the ten and two o'clock positions on the head portion 14 of the racquet 10, when viewing the racquet 10 from the front side with the opening 20 in full view and the handle assembly 18 downwardly extending from approximately the six o'clock position of the head portion 14. In other alternative preferred embodiments, the size and position of the three guide portions 36, 38 and 40 can vary with respect to each other and with respect to the head portion 14. In another alternative preferred embodiment, the bumper guard 12 can be formed entirely of a single piece, two separate pieces, or four or more separate pieces. The multi-piece configurations of the bumper guard, such as the embodiment of FIG. 2, enables the user, if desired, to replace only a portion of the bumper guard without necessarily having to replace the entire bumper guard.

Figure 3:
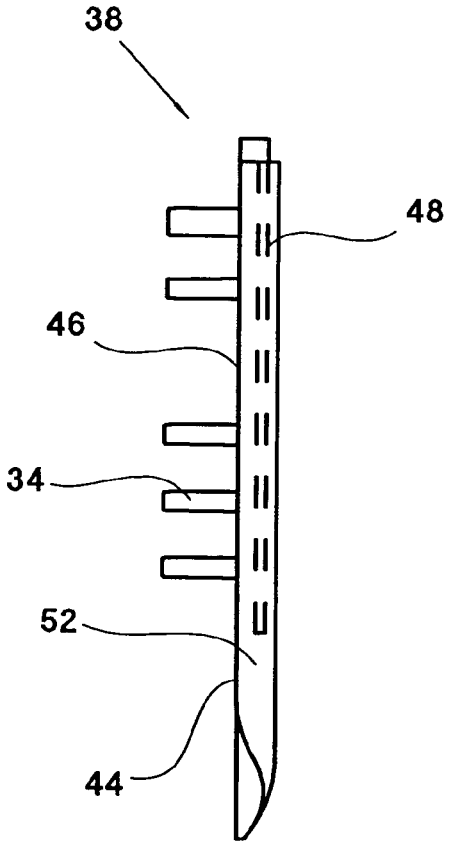
FIG. 3 is a side view of a first end guard portion of the bumper guard of FIG. 2.
Figure 4:
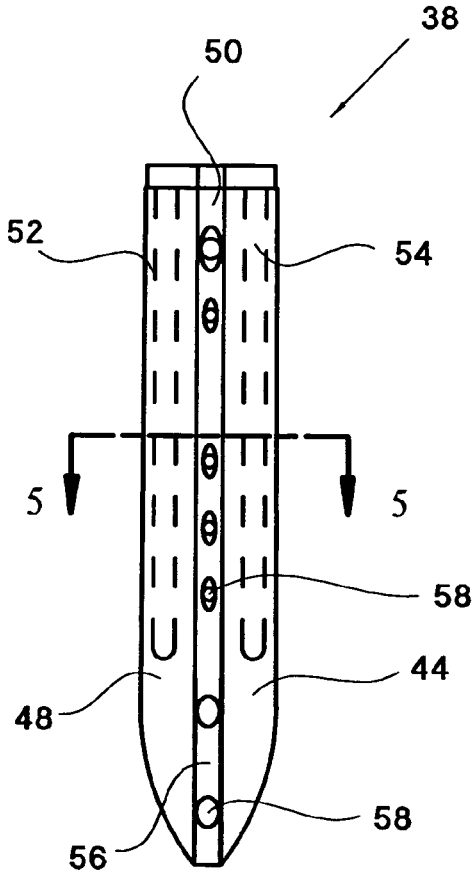
FIG. 4 is a top view of the first end guard portion of FIG. 3.
Figure 5:
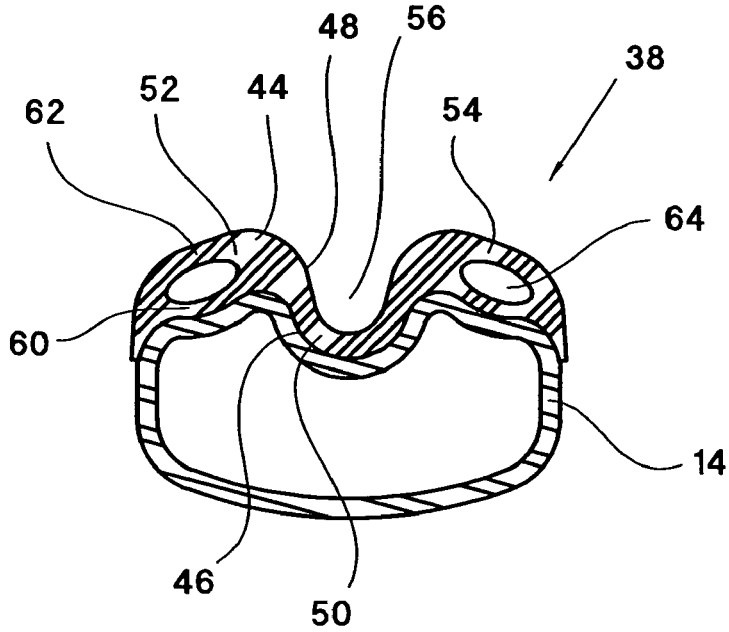
FIG. 5 is a cross-sectional view of the first end guard portion taken along line 5—5 of FIG. 4.

Referring to FIGS. 3–5, the first end guard portion 38 is shown in greater detail. The first and second end guard portions 38 and 40 are preferably substantially the same and are symmetrically positioned about a longitudinal axis 42 of the racquet 10. Accordingly, the following description of the first end guard portion 38 is directly applicable to the second end guard portion 40. The first end guard portion 38 has an elongate body 44 having a first length, an inner surface 46 and an outer surface 48. The body 44 is configured to generally conform to the outer surface 24 of the head portion 14 (FIG. 2).

The body 44 further includes a central region 50, centrally and longitudinally extending along the body 44 of the end guard portion 38, and first and second wings 52 and 54, attached to and, extending away from the central region 50. When the end guard portion 38 is installed onto the racquet 10, the central region 50 is generally centered about the plane defined by the string bed 22. A second elongate recess 56 is defined into the outer surface of the central region 50. The second recess 56 is configured to correspond with the first recess 30 (also FIG. 2) in the head portion 14 of the racquet 10. The central region 50 further includes a plurality of bumper string holes 58 spaced apart along the central region 50, and aligned with, and extending through, the grommet members 34, which inwardly extend from the inner surface of the central region 50. The string holes 58 can be sized to receive a single string segment, or two or more string segments. The grommet members 34 are positioned and sized to correspond with, and extend through, the grommet holes 28 (FIG. 2) of the head portion 14. Referring to FIG. 3, in a particularly preferred embodiment, the end guard portion 38 includes five inwardly extending grommet members 34. In alternative preferred embodiment, the end guard portion can include other numbers of grommet members.

Referring to FIG. 5, each wing 52 and 54 includes an inner wall 60 and an outer wall 62, which are spaced apart to form an elongate hollow cavity 64. The inner wall 60 extends over, and preferably contacts, the outer surface 24 of the head portion 14. The hollow cavity 64 has a second length that is less than the first length of the body 44 of the first end guard portion 38. The hollow cavities 64 in the wings of the end guard portion 38 are configured to enable the outer wall 62 to deflect inward during impact with a hard surface, such as the playing surface, walls or other hard objects, thereby absorbing and dissipating some of the force associated with the impact. More severe impacts may lead to compression of the outer wall 62 into the hollow cavity 64 to such a degree that it closes a portion of the cavity 64 and contact results between the inner and outer walls 60 and 62 of one or both of the wings 52 and 54. The inner wall 62 serves as a second protective layer of material further helping to absorb the impact and preventing abrasive or rubbing contact between the outer wall 62 and the outer surface 24 of the head portion 14 (FIG. 2).

This configuration of the end bumper guard 38 helps to reduce the amount of shock and vibration applied to the head portion of the racquet and ultimately to the user. The cavities 64 within the end bumper guard 38 also allow for weight to be removed from the bumper guard without negatively affecting performance of the bumper guard 12. Accordingly, the present invention enables unnecessary or undesirable weight to be removed from the bumper guard 12. The inner and outer walls 60 and 62 provide a double layer of protection and inhibit undesirable rubbing or abrasions between the outer wall of the bumper guard, or from any material that may be present within the cavities 64.

In alternative preferred embodiments, each wing can have two or more hollow cavities positioned in a spaced apart manner along the length of the end bumper guard. In another alternative preferred embodiment, the hollow cavity can extend the entire length of the end bumper section.

Figure 6:
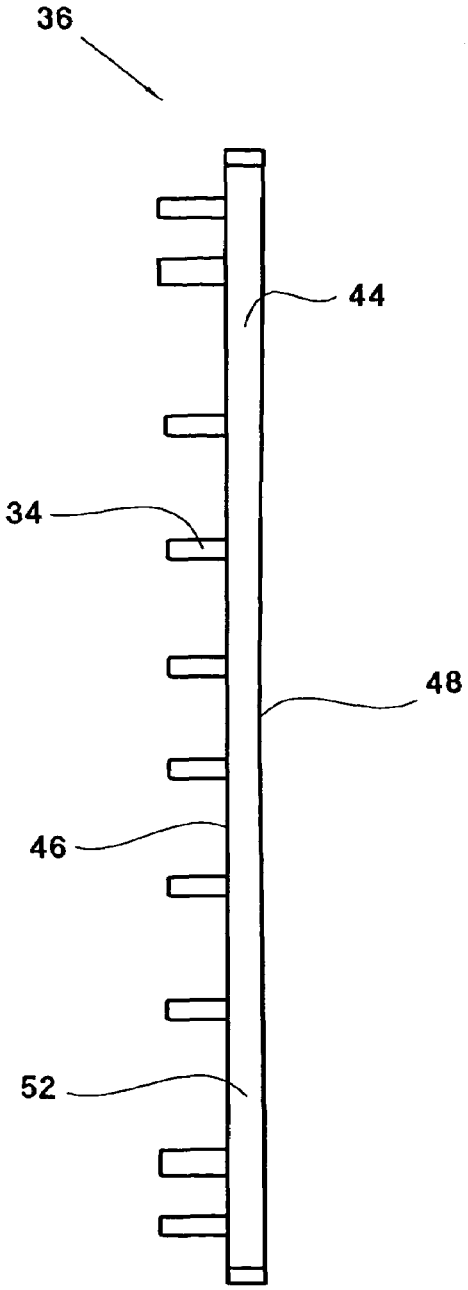
FIG. 6 is a side view of a central guard portion of the bumper guard of FIG. 2.
Figure 7:
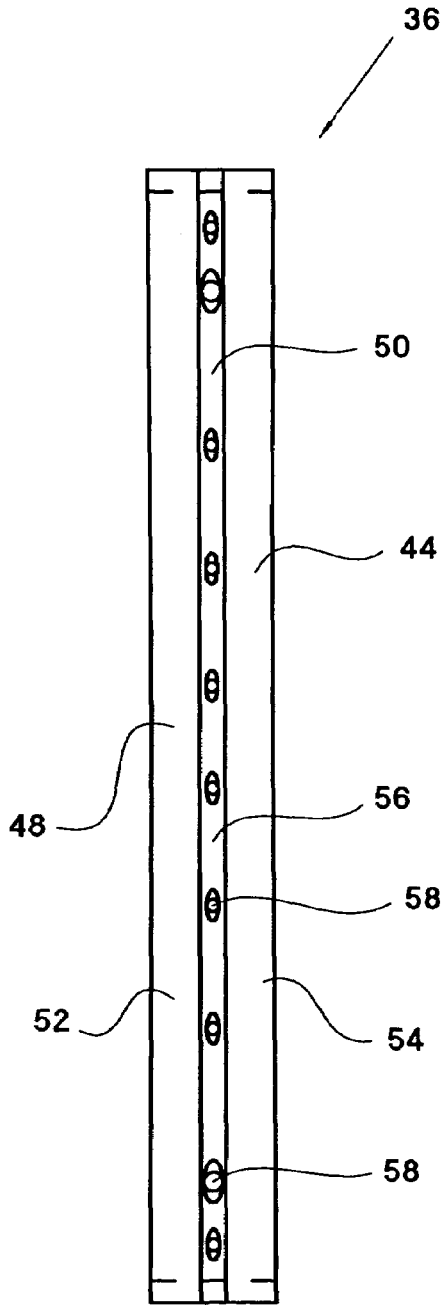
FIG. 7 is a top view of the central guard portion of FIG. 3.
Figure 8:
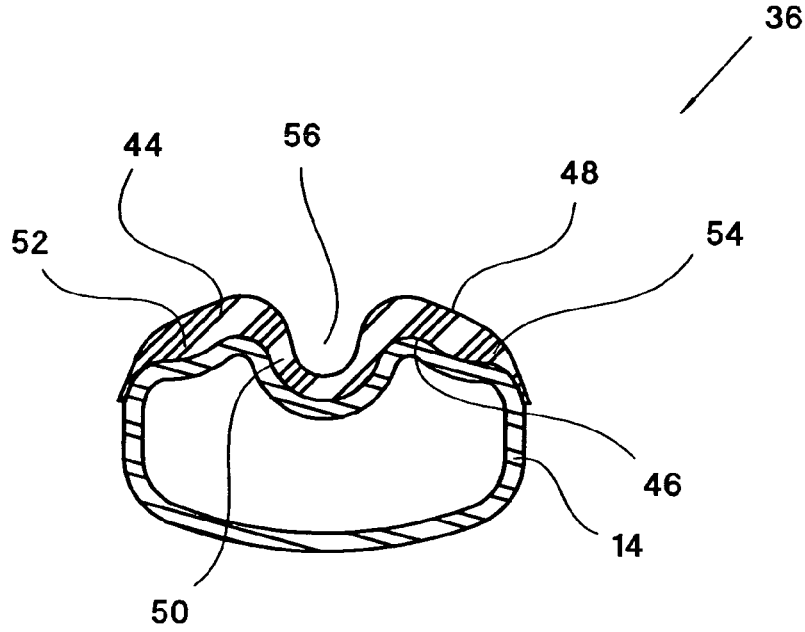
FIG. 8 is a cross-sectional view of the central guard portion of FIGS. 6 and 7.

Referring to FIGS. 6 through 8, one preferred embodiment of the central guard portion 36 is shown in greater detail. The central guard portion 36 is configured to be very similar to the first and second end portions 38 and 40, including the central region 50, the first and second wings 52 and 54, the second recess 56, and the grommet members 34. The central guard portion 36 differs from the first and second end portions 38 and 40 in that the wings of the central guard portion 36 do not include inner and outer walls defining one or more hollow cavities. This configuration illustrates one embodiment of the present invention, wherein certain portions of the periphery of the head portion of the racquet are covered by a guard portion (e.g., first and second end portions), which have hollow cavities in the wings for providing additional wear, and shock and vibration absorption protection, and other portions of the periphery of the head portion receive a more conventional bumper guard configuration. This enables those regions of the periphery of the head portion most susceptible to impacts with hard surfaces or objects to receive the added benefit and protection of the hollow cavities and other portions to include more conventional bumper guard protection.

The bumper guard 12, including the first and second end guard portions 38 and 40 and the central guard portion 36, is formed of a lightweight, wear resistant, durable material, preferably a nylon. Alternatively, other materials can be used, such as other a polyamide, a generally rigid polymer, other polymeric materials and combinations thereof. In a preferred embodiment, the body has a durometer of greater than 95 on the Shore A hardness scale. In alternative preferred embodiments, the body can be formed of a material having a durometer that is less than 95 on the Shore A hardness scale. In a preferred embodiment, the bumper guard 12 is attached to the outer surface 24 of the head portion 14 by the grommet members 34 engagement with the grommet holes 28 and by the racquet string 32 extending through the grommet members 34 and along portions of the bumper guard 12. In other alternative preferred embodiments, the bumper guard can also be attached by one or more snap fit or interlocking connection with the head guard, an adhesive or a combination thereof. Each of the first and second end guard portions 38 and 40 and the central guard portion 36 is preferably formed as an integral molded component. In an alternative preferred embodiment, the body of the first end portion, second end guard portion or central guard portion can be formed as an extrusion with the grommet members attached to an inner surface of the extrusion.

Figure 9:
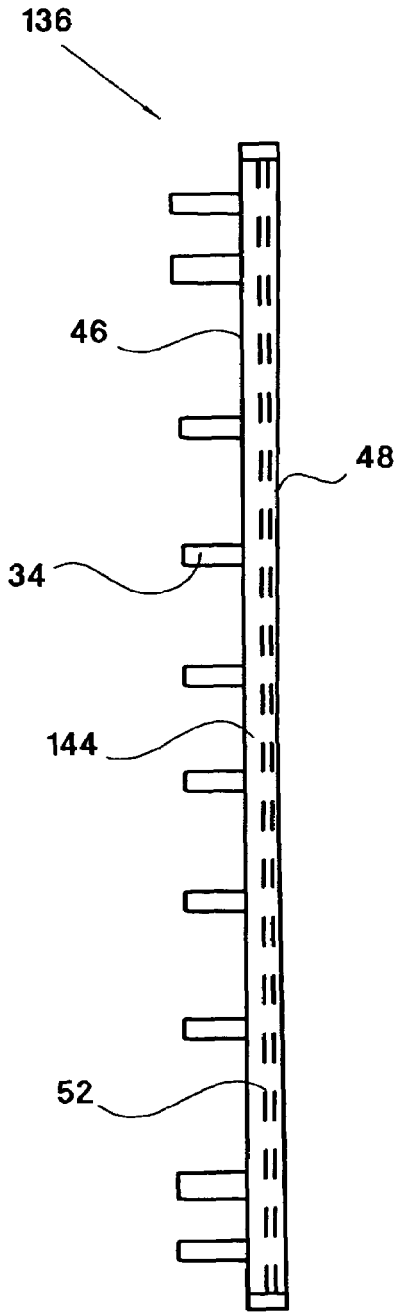
FIG. 9 is a side view of a central guard portion of a bumper guard in accordance with an alternative preferred embodiment of the present invention.
Figure 10:
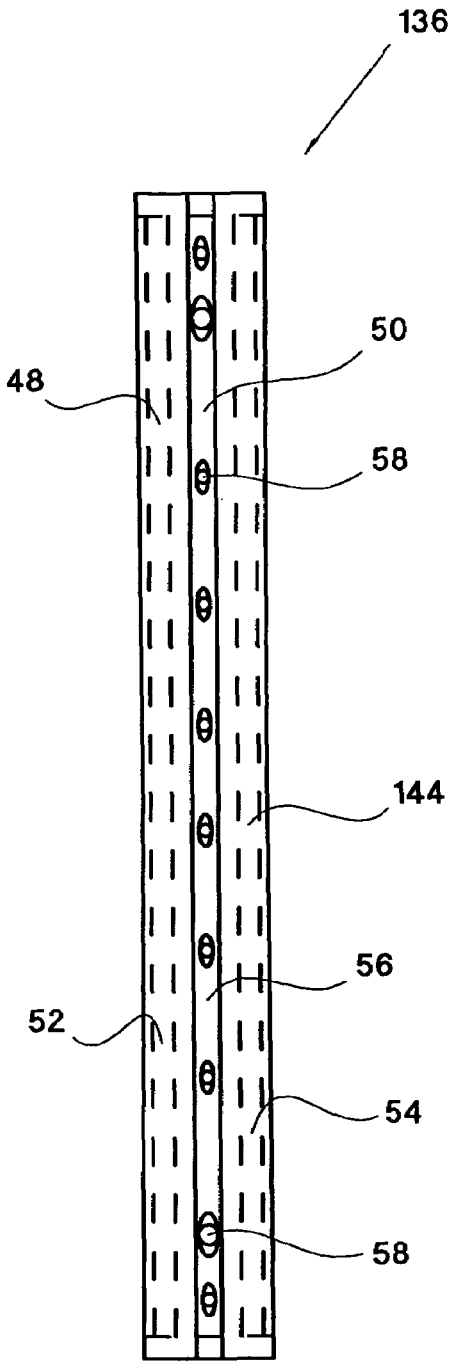
FIG. 10 a top view of the central guard portion of FIG. 9.

Referring to FIGS. 9 and 10, an alternative preferred embodiment of a central guard portion 136 is illustrated. In this embodiment, the central guard portion 136 is configured with the hollow cavities 64 extending along the entire length of a body 144 of the central guard portion 136 within each of the wings 52 and 54. The central guard portion 136 therefore has a cross-sectional configuration, which is substantially the same as that shown in FIG. 5. Accordingly, the central guard portion 136 includes substantially all the features of the first and second end guard portions 38 and 40. In alternative preferred embodiments, the each of the wings of the central guard portion 136 can include two or more hollow cavities in a spaced apart configuration along the length of the body 144 of the central guard portion 136.

Figure 11:
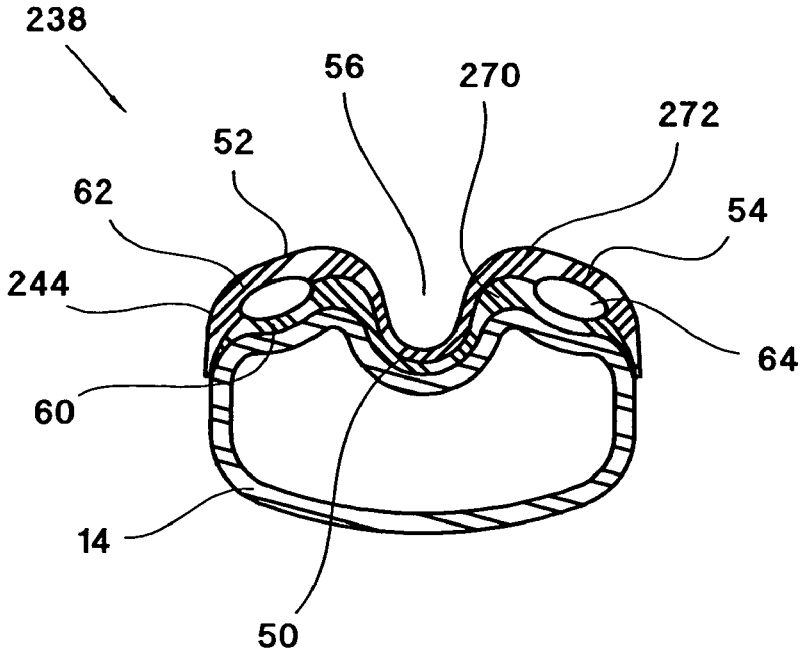
FIG. 11 is a cross-sectional view of a bumper guard taken in accordance with another alternative preferred embodiment of the present invention.

Referring to FIG. 11, a cross-sectional view of an alternative preferred embodiment of an end guard portion 238 is illustrated. In this embodiment, the end guard portion 238 includes a body 244, which is formed of an inner layer 270 and an outer layer 272. A portion of the inner and outer layers 270 and 272 are separated to define a cavity 264. The inner and outer layers are firmly joined to each other, preferably bonded together. Alternatively, the inner and outer layers can be joined through an adhesive or through other conventional mechanical connections, such as, for example, snap-fit interlocking connections. The two piece body of the end guard portion 238 can also be used for the second guard portion or for the central guard portion. Preferably, the inner layer 270 spaces apart and separates the outer layer 272 from the head portion 14 of the racquet 10.

Figure 12:
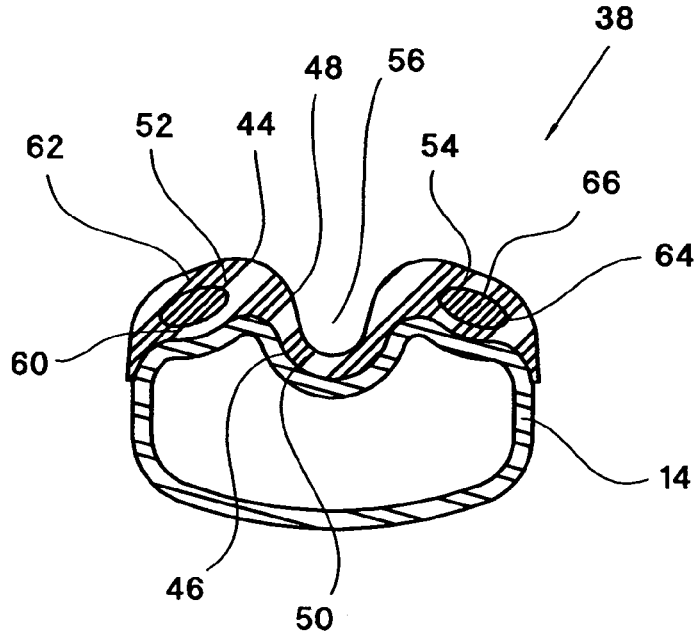
FIG. 12 is a cross-sectional view of a bumper guard taken in accordance with another alternative preferred embodiment of the present invention.

Referring to FIG. 12, in another alternative preferred embodiment, the hollow cavities 64 can be filled with a gas, a fluid or an elastomeric material 66. The added material can be used to vary the dampening and impact resistance characteristics of the bumper guard.

While the preferred embodiments of the present invention have been described and illustrated, numerous departures therefrom can be contemplated by persons skilled in the art. Therefore, the present invention is not limited to the foregoing description but only by the scope and spirit of the appended claims.

What is claimed is:

1. A bumper guard for attachment to a sports racquet, the sports racquet including a frame having a head portion with an outer peripheral surface and a plurality of grommet holes formed into the head portion for supporting a string bed, the bumper guard comprising:

an elongate body having a first length, an inner surface and an outer surface, the body including a central region, which when installed on the racquet is generally centered about a plane defined by the string bed, and first and second wings extending from the central region, the inner surface of the body configured to generally conform with the peripheral outer surface of the head portion, each of the first and second wings having an inner wall and an outer wall defining at least one elongate hollow cavity, the inner wall of each of the first and second wings extending from the central region and being configured to contact the outer peripheral surface of the racquet.

2. The bumper guard of claim 1, wherein the elongate body includes a second elongate recess extending along the central region of the body, and wherein the second recess is configured to correspond with a first elongate recess formed into the outer peripheral surface of the racquet.

3. The bumper guard of claim 1, further comprising at least two spaced apart generally cylindrical grommet members attached to and extending generally perpendicular from the inner surface, and at the central region, of the body, and wherein the grommet members are configured to extend into the grommet holes of the head portion.

4. The bumper guard of claim 1, wherein the bumper guard includes a central guard portion and first and second end guard portions.

5. The bumper guard of claim 4, wherein the first and second guard portions are positioned at opposite ends of the central guard portion.

6. The bumper guard of claim 5, wherein only the first and second end guard portions of the bumper guard include the first and second wings having inner and outer walls which define the elongate hollow cavity.

7. The bumper guard of claim 1, wherein at least one of the elongate cavities is filled with a material selected from the group consisting of a fluid, a gas, an elastomeric material, and combinations thereof.

8. The bumper guard of claim 1, wherein each of the first and second wings defines at least two spaced apart elongate hollow cavities.

9. The bumper guard of claim 1, wherein the body is formed of an inner layer and an outer layer, and wherein the outer layer is configured to be free from contact with the head portion.

10. The bumper guard of claim 1, wherein the cavity has a second length that is less than the first length of the body.

11. The bumper guard of claim 1, wherein the body is formed of a material selected from the group consisting of nylon, a generally rigid polymer, a polyamide and combinations thereof.

12. The bumper guard of claim 11, wherein the material of the body has a durometer of greater than 95 on the Shore A hardness scale.

13. A sports racquet including:

a frame having a head portion with an outer peripheral surface and a plurality of grommet holes formed into the head portion;

a string bed supported by the head portion; and a bumper guard removably engaged with the frame, the bumper guard including, an elongate body having a first length, an inner surface and an outer surface, the body including a central region generally centered about a plane defined by the string bed, and first and second wings extending from the central region, the inner surface of the body generally conforming with the peripheral outer surface of the head portion, each of the first and second wings having an inner wall and an outer wall defining at least one elongate hollow cavity, the inner wall of each of the first and second wings extending from the central region and contacting the outer peripheral surface of the racquet.

14. The racquet of claim 13, wherein the racquet includes a first elongate recess formed into the outer peripheral surface elongate body, and wherein the bumper guard includes a second elongate recess extending along the central region of the bumper guard, and wherein the first recess is configured to correspond with the second recess.

15. The racquet of claim 13, further comprising at least two spaced apart generally cylindrical grommet members attached to and extending generally perpendicular from the inner surface, and at the central region, of the body, and wherein the grommet members are configured to extend into the grommet holes of the head portion.

16. The racquet of claim 13, wherein the bumper guard includes a central guard portion and first and second end guard portions.

17. The racquet of claim 16, wherein the first and second guard portions are positioned at opposite ends of the central guard portion.

18. The racquet of claim 17, wherein only the first and second end guard portions of the bumper guard include the first and second wings having inner and outer walls which define the elongate hollow cavity.

19. The racquet of claim 13, wherein at least one of the elongate cavities is filled with a material selected from the group consisting of a fluid, a gas, an elastomeric material, and combinations thereof.

20. The racquet of claim 13, wherein each of the first and second wings defines at least two spaced apart elongate hollow cavities.

* * * * *